US010184622B2

(12) United States Patent
Dong et al.

(10) Patent No.: US 10,184,622 B2
(45) Date of Patent: Jan. 22, 2019

(54) ELECTRICAL SUPPLY AND SHELF SYSTEM HAVING SAME

(71) Applicants: Self Electronics Co., Ltd.; Wanjiong Lin, Ningbo, Zhejiang (CN); Self electronics USA Corporation

(72) Inventors: Jianguo Dong, Zhejiang (CN); Kai Xu, Zhejiang (CN); Dong Chen, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 15/823,268

(22) Filed: Nov. 27, 2017

(65) Prior Publication Data

US 2018/0306392 A1 Oct. 25, 2018

(30) Foreign Application Priority Data

Apr. 19, 2017 (CN) ..... 2017 1 0256039

(51) Int. Cl.

| | |
|---|---|
| ***F21V 33/00*** | (2006.01) |
| ***F21S 4/28*** | (2016.01) |
| ***F21V 21/005*** | (2006.01) |
| ***F21V 23/02*** | (2006.01) |
| ***A47B 96/02*** | (2006.01) |
| ***F21V 23/06*** | (2006.01) |
| *F21Y 115/10* | (2016.01) |
| *F21W 131/301* | (2006.01) |

(52) U.S. Cl.

CPC ..... *F21S 4/28* (2016.01); *A47B 96/02* (2013.01); *F21V 21/005* (2013.01); *F21V 23/023* (2013.01); *F21V 23/06* (2013.01); *F21V 33/0012* (2013.01); *F21W 2131/301* (2013.01); *F21Y 2115/10* (2016.08)

(58) Field of Classification Search

CPC ..... A47B 97/00; A47B 21/00; A47B 21/06; A47C 7/72; A47C 7/725; H02J 5/005; H02J 7/025

USPC ..... 362/127

See application file for complete search history.

(56) References Cited

U.S. PATENT DOCUMENTS

2013/0188338 A1* 7/2013 Melhaff ..... A47B 57/485 362/127

* cited by examiner

*Primary Examiner* — Jamara Franklin

(74) *Attorney, Agent, or Firm* — Wang Law Firm, Inc.

(57) ABSTRACT

A shelf system and a label LED strip lamp includes a shelf and a label LED strip lamp. Each of at least one carrier element includes a body, and a clamping assembly. The clamping assembly includes a clamping slot and a catch plate provided on the clamping slot. The label LED strip lamp includes a snap assembly for engagement with the catch plate, and a lamp tube. The snap assembly includes a connecting edge, a set of clamping tooth disposed on one side of the connecting edge, and a wavy-shaped engaging edge spaced from the clamping tooth. The clamping tooth inserts into the clamping slot. The lamp tube includes a non-transparent edge, an upper light transmitting edge connecting the non-transparent edge with the catch plate, and a lower light transmitting edge.

12 Claims, 8 Drawing Sheets

ELECTRICAL SUPPLY AND SHELF SYSTEM HAVING SAME

RELATED APPLICATION

The present application claims the benefit of Chinese Application, CN 201710256039.3, filed on Apr. 19, 2017.

BACKGROUND

1. Technical Field

The present application relates to lighting equipments, and more particularly to an electrical supply and a shelf system having same.

2. Description of the Related Art

Light emitting diode (LED) is growing in popularity due to decreasing costs and long life compared to incandescent lighting and fluorescent lighting. Recently, a number of LED lighting apparatuses have been designed to replace the halogen apparatus, as well as other traditional incandescent or fluorescence lighting apparatuses. In some places such as exhibition halls, jewelry stores, museums, supermarkets, and some home lighting, such as large villas, will use a lot of strip LED lamps. Moreover, in addition to lighting equipments, such as general traffic lights, billboards, motor-lights, etc., also use light-emitting diodes as light source. As described above, for the light-emitting diodes as a light source, the advantage is power saving, and the greater brightness. Therefore, the use has been gradually common.

In the prior art, a power source for supplying electric power to the LED lighting mounted on the shelf irradiation surface is generally provided on the back of the shelf. Therefore, it is necessary to pass through wires from the shelf irradiation surface to the back of the shelf so as to electrically connect the LED lighting with the power source supply. On one hand, it is inconvenient to arrange the wires and has more and messy wires due to the above power supply method. As a result, it is not advantageous for maintenance and aesthetics. On the other hand, as the shelves are required to have a strong versatility to be able to place different kinds of goods, it is necessary to set different mounting position of the shelf boards, such as removing it or replacing it. A patent application, whose Chinese application number is CN201520163602.9 and title is a power supply system for shelf track lighting device, publicizes a shelf for solving the above problems. However, the ejection plug provided on the support arm of the shelves protrudes from the side of the support arm. Usually for beauty of the shelves, the components, including vertical rails, backboards, or the like, have very small tolerance. However, when the backboards have slightly wrong, it may be difficult to install these components due to the ejection plug provided on the support arm.

Therefore, it is necessary to provide an electrical supply and shelf system having same which makes it possible to solve the above problems.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout two views.

DETAILED DESCRIPTION

The present application is illustrated by way of example and not by way of limitation in the figures of the accompanying drawings. It should be noted that references to "an" or "one" embodiment in this application are not necessarily to the same embodiment, and such references mean at least one.

Figure 1:
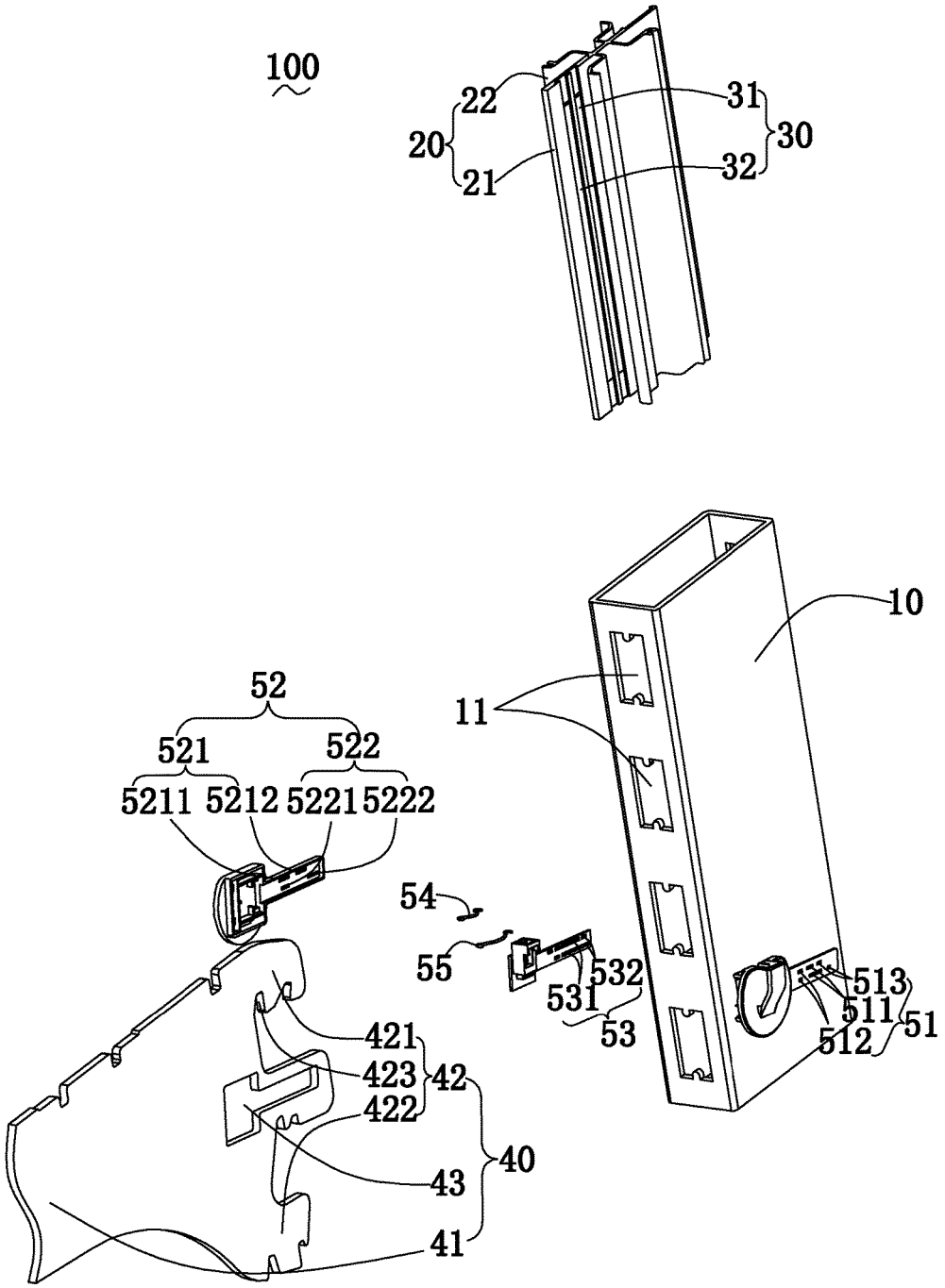
FIG. 1 is an explored view of an electrical supply and a shelf system according to a first embodiment.

Referring to FIG. 1, a shelf system 100 according to a first embodiment is shown. The shelf system 100 includes a plurality of vertical shelf rails 10, supporters 20 disposed in the vertical shelf rails 10, bus bars 30 arranged in the supporters 20, at least one support arm 40 arranged in each of the vertical shelf rails, and at least one electrical supply 50 disposed on the support arm 40. As well known, for a complete shelf system, it further includes some supporting elements, such as carrying board, and so on, and further includes label led strips, lightings, bases for inserting the vertical shelf rails 20, backboard, and so on. However, for those skilled in the art, it no needs to describe in detail.

The vertical shelf rails 10 are hollow rails having a rectangle cross-section. Each of the vertical shelf rails 10 includes at least one row of punched holes 11. Each of rows has a plurality of punched holes 11. Understandably, the shelf system 100 has at least two vertical shelf rails 10. The two vertical shelf rails 10 are arranged in parallel and also vertical to the ground and a base is provided horizontally on the bottom of the two vertical shelf rails 10. Moreover, when the shelf system 100 includes three or more the vertical shelf rails 10, the vertical shelf rails 10 may not be arranged into a line. The vertical shelf rails 10 may be mounted on the ground or a wall. When the vertical shelf rails 10 are mounted on the wall, it can be directly fixed on the wall or hanged on the wall, such as horizon bar. In the present embodiment, the vertical shelf rails 10 are a rectangular tube and include four side walls which form into an inner cavity 12. Two opposite side walls of each of the vertical shelf rails 10 are respectively arranged two rows of the punched holes 11 which pass through the side walls to form a passage between the inner cavity 12 and outer space. The two rows of the punched holes 11 are arranged side by side along the lengthwise direction of the vertical shelf rails 10. Each row has a plurality of punched holes 11 and the punched holes 11 have an equal distance therebetween. The punched holes 11 are used to insert the support arm 40 therein and the carrying board or supporting elements can be provided at different heights. Each of the punched holes 11 is a slot and has a little width, about 4 or 5 mm so that it is difficult for any finger of an adult to insert into the punched holes 11. Each of the punched holes 11 has a height of about 20 mm. The adjacent two punched holes 11 have the same interval, such as 30, 40, 50 mm. Understandably, the above parameter can be changed according to actual desires.

The supporters 20 are made of insulate material and includes a supply strip placement board 21 and two abutting boards 22 arranged two sides of the supply strip placement board 21 and spaced apart from the supply strip placement board 21. The electrical supply 50 is inserted between the supply strip placement board 21 and one of the two abutting boards 22. The supporters 20 are fixed into the inner cavity 12 of the vertical shelf rails 10. In a cross section perpendicular to the extending direction of the vertical shelf rails 10, the supply strip placement board 21 has a same length with the inner cavity 12, and a maximum distance between the two abutting boards 22 is same as a width of the inner cavity 12. Therefore, as the supporters 20 are inserted into the inner cavity 12 of the vertical shelf rails 10, the supporters 20 are fixed between the supply strip placement board 21 and the vertical shelf rails 10.

The bus bars 30 is configured for supplying low voltage, in particular, direct current, and includes a first conductive bar 31 for supplying first electrode current and a second conductive bar 32 for supplying second electrode current. The first, second conductive bars 31, 32 are public circuit and are used to supplying voltage of different electrode and are arranged on the supply strip placement board 21. The first, second conductive bars 31, 32 are in parallel disposed on the supply strip placement board 21 and spaced apart from each other. Understandably, each of the supporters 20 may have two bus bars 30 disposed thereon and arranged on two sides of the supporters 20 respectively. When the first, second conductive bars 31, 32 are embedded onto the supply strip placement board 21, they are insulated by an insulating material from each other and are packaged by a concave and convex ear made of the insulating material to provide additional non-conductive contact protection. In the shelf system 100, the orientation of the vertical shelf rail 10 need not be considered as the front and back sides of the vertical shelf rail 10 are the same. The support arm 40 is assembled onto the front side or the back side of the vertical shelf rail 10 and a power socket for providing an interface for a lighting device or other electric devices is provided by the first and second conductive bars 31 and 32, respectively.

The support arm 40 may be made of steel plate, and particularly, is made by stamping and bending into a stamping parts. The support arm 40 includes a bearing section 41, and a nose-shaped insertion hook 42 configured for engaging with the punched holes 11. The bearing section 41 is used to place some carrier element and extends from the nose-shaped insertion hook 42. The bearing section 41 is inserted into the punched holes 11 of the vertical shelf rail 10 and is supported on the front side or the back side of the vertical shelf rail 10 in via of the nose-shaped insertion hooks 42. The nose-shaped insertion hook 42 includes two sections, that is, a first hook 421 and a second hook 422 spaced apart from the first hook 421. The first hook 421 has a nose-shaped hook towards down which forms on one edge of the support arm 40. A notch 123 is downwardly opened on the nose-shaped hook. The second hook 422 may also have a nose-shaped hook. However, in the present embodiment, the second hook 422 is straight edge extension for conveniently installing. A distance between the straight edge extension and the nose-shaped hook is equal to the minimum distance between the two punched holes 11. When the support arm 40 is assembled onto the vertical shelf rail 10, the first, second hooks 421, 422 are inserted into two punched holes 11 respectively and a side wall of the vertical shelf rail 10 is inserted into the notch 423. Moreover, since the first, second hooks 421, 422 are respectively inserted into the two punched holes 11, a connection section between the first, second hooks 421, 422 abut against on the side wall of the vertical shelf rail 10. As a result, the support arm 40 are hooked into and suspended onto the vertical shelf rail 10. The support arm 40 further includes an open 43 for assembling the electrical supply 50. The open 43 may be disposed on the first hook 421 or the second hook 422 of the nose-shaped insertion hook 42 of the support arm 40 by a pressing process. When the nose-shaped insertion hook 42 is inserted into the punched holes 12, the whole nose-shaped insertion hook 42, or only the first hook 421, or only the second hook 422 is inserted between the supply strip placement board 21 and the abutting boards 22. As a result, the electrical supply 50 and the bus bars 30 are electrically connected.

Figure 2:
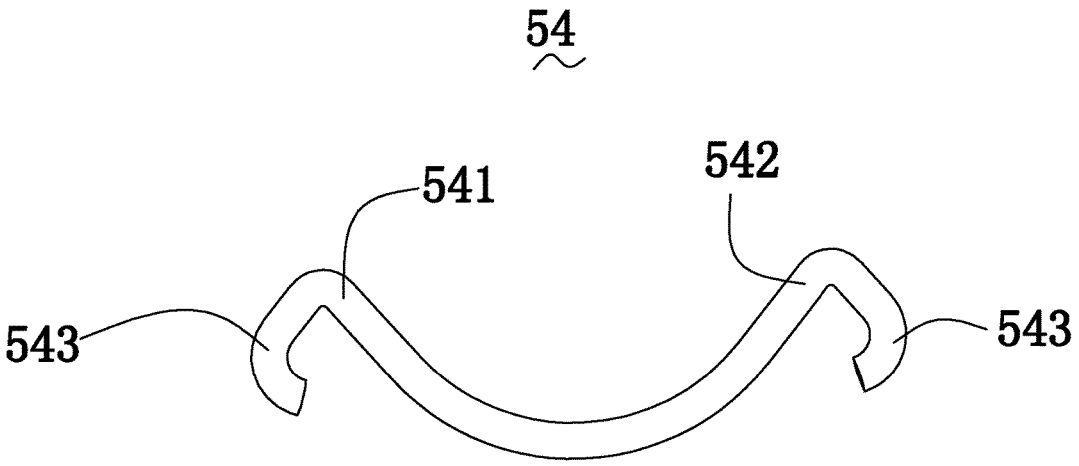
FIG. 2 is a schematic view of a positive electrical contact of the electrical supply of the shelf system of FIG. 1.
Figure 3:
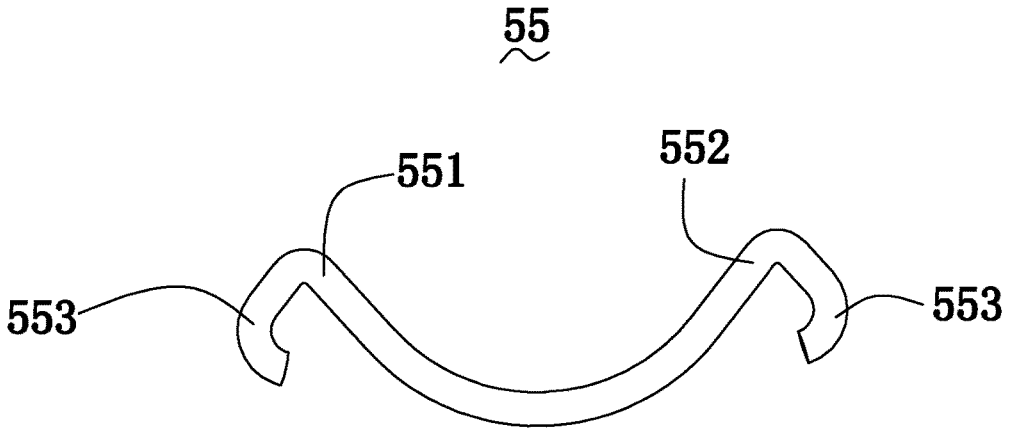
FIG. 3 is a schematic view of a negative electrical contact of the electrical supply of the shelf system of FIG. 1.

The electrical supply 50 includes a bottom cover 51, and a top cover 52 mounted on the bottom cover 51, a sandwich plate 53 arranged between the bottom cover 51 and the top cover 52, a positive current collector 54 and a negative current collector 55 sandwiched between the top cover 52 and the bottom cover 51. Understandably, the electrical supply 50 further includes other function elements, such as power plug assembly, wires, and so on, which are well known by those skilled in the art and not be described in detail. The bottom and top covers 51, 52 may be made of insulating material and form a recess to contain the power plug assembly, wires, circuit board, the sandwich plate 53, and the positive and negative power contacts 54, 55. Therefore, the specific structure of the bottom cover 51 and the top cover 52 is based on forming such the recess. Need to further explain that the power plug assembly is usually mounted on the outer side wall of the vertical shelf rail 10 as it has a larger size so as to further reduce the size of the vertical shelf rail 10 and the support arm 40. The structure designed on the bottom cover 51 and the top cover 52 for setting the power plug assembly is a prior art and will not be described in detail here. The top cover 52 includes two rows of positive collector hole 521 and negative collector hole 522 which are spaced apart from each other. The positive and negative collector holes 521, 522 are rectangular slot so as that the positive and negative power contacts 54, 55 can move therein. The positive collector hole 521 includes a first positive hole 5211 and a second positive hole 5212 space apart from the first positive hole 5211. The negative collector hole 522 includes a first negative hole 5221 and a second negative hole 5222 spaced apart from the first negative hole 5221. Referring to FIG. 2 and FIG. 3 together, the positive and negative power contacts 54, 55 have same structure and work principle. The positive and negative power contacts 54, 55 are arc-shaped groove and include two free ends and a middle section. Specifically, the positive collector 54 includes a first positive free end 541 and a second positive free end 542. The negative collector 55 includes a first negative free end 551 and a second negative free end 552. The middle sections of the positive and negative power contacts 54, 55 are abutted against the bottom cover 51. In order to save space and reduce a distance between the bottom cover 51 and the top cover 52, two slots 511 are opened on the bottom cover 51 and are configured for receiving the positive and negative collector 54, 55 respectively. The slots 511 may be through hole. Portions where the positive and negative power contacts 54, 55 are in contact with the bottom cover 51 are received in the slots 511. Moreover, in order that the middle section of the positive and negative power contacts 54, 55 slides in the slots 511 respectively, the portions where the positive and negative power contacts 54, 55 are in contact with the slots 511 are arc-shaped surface. The first, second positive free ends 541, 542 of the positive collector 54 are respectively inserted into the first and second positive holes 5211, 5212. The first, second negative free ends 551, 552 of the negative collector 55 are respectively inserted into the first and second positive holes 5221, 5222. As a result, the positive and negative collector 54, 55 are sandwiched between the bottom cover 51 and the top cover and is prevented from falling off.

Since when the support arm 40 is inserted into the vertical shelf rail 10, the first and second positive free ends 541, 542 and the first and second negative free ends 551, 522 need to slide on the bus bars 30 and the supply strip placement board 21. Each of the free ends of the positive and negative collector 54, 55 include a curling portions 543, 553. The curling portions 543, 553 are curved outward of the positive and negative power contacts 54 and 55. Therefore, the bottom cover 52 includes two receiving slots 512, 513 configure for receiving the curling portions 543, 553 respectively while the curling portion 543, 553 are pressed into the bottom cover 51. The electrical supply 50 is mounted into the open 43 of the support arm 40 by means of interference fit.

Figure 4:
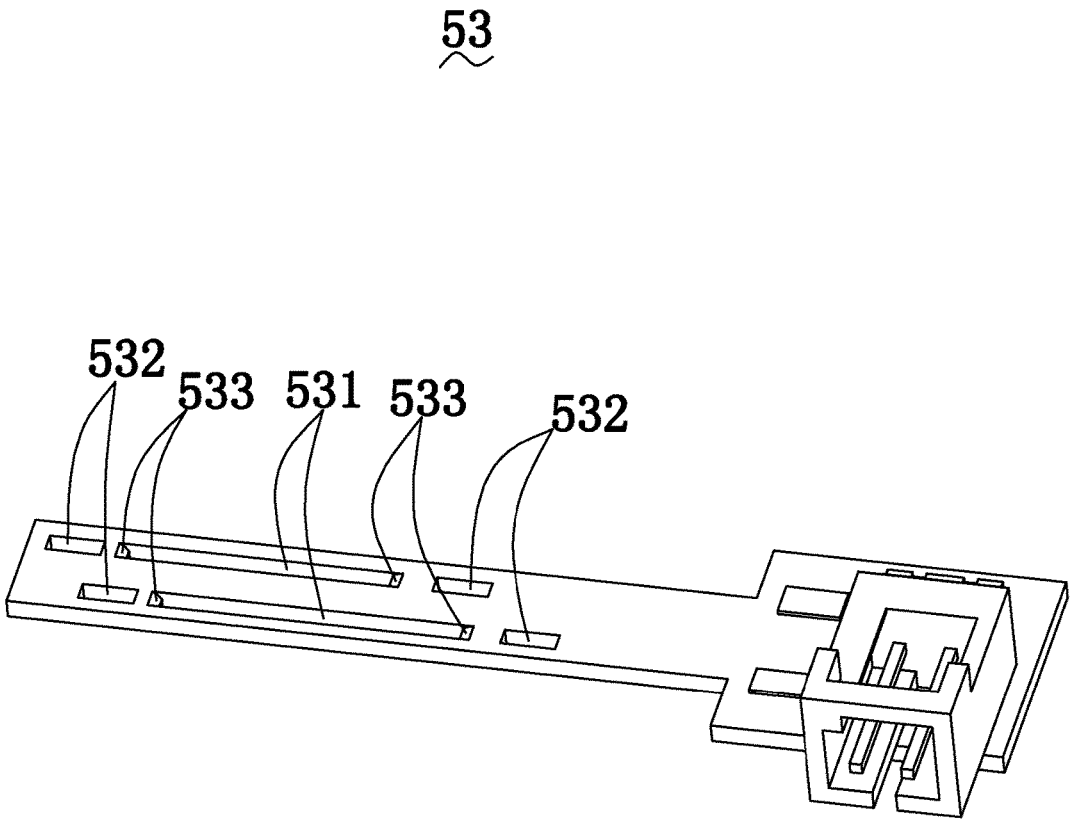
FIG. 4 is a schematic view of a sandwich panel of the electrical supply of the shelf system of FIG. 1.

As shown in FIG. 4, the sandwich plate 53 is configured for arranging wires so as to electrically connect the positive and negative power contacts 54, 55 and the power plug assembly. The sandwich plate 53 includes two slots 531 and four through holes 532. The two slots 531 are configured for respectively crossing through the middle sections of the positive and negative power contacts 54, 55. The four through holes 532 is configured for respectively crossing through the four curling portions 543, 553 of the positive and negative power contacts 54, 55. An electrical contact 533 is disposed on each of the two slots 531 so as to electrically connect to the positive and negative collector 54, 55 respectively. The electrical contact 533 is coated on the sidewall of the slots 531 along the length direction.

Figure 5:
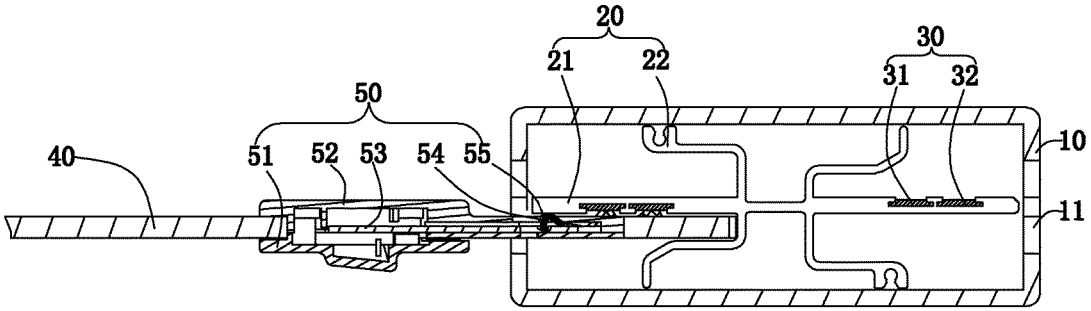
FIG. 5 is a sectional view of the shelf system of FIG. 1.

Referring to FIG. 5 together, during assembling the support arm 40 and the vertical shelf rail 10, the nose-shaped insertion hook 42 of the support arm 40 is inserted into the punched hole 11 of the vertical shelf rail 10 and hooked onto the punched hole 11. While the support arm 40 is inserted into the punched hole 11, the nose-shaped insertion hook 42 is inserted between the supply strip placement board 21 and the abutting boards 22 together with the electrical supply 50. During inserting the electrical supply 50, one of the free ends of the positive and negative power contacts 54, 55, in the present embodiment the first positive free end 541 and the first negative free end 551, are firstly pressed into the first positive hole 5211 and the first negative hole 5221 of the positive and negative collector holes 521, 522 of the top cover 52 respectively. The first positive free end 541 and the first negative free end 551 move towards the top cover 52 and the positive and negative power contacts 54, 55 rotate firstly so as to make the second positive free end 542 and the first negative free end 552 move away from the top cover 52. When the respective two free ends of the positive and negative power contacts 54, 55 are inserted between the supply strip placement board 21 and the abutting boards 22, the two free ends will be respectively pressed into the first and second positive hole 5211, 5212 and the first and second negative positive hole 5221, 5222, and the positive and negative power contacts 54, 55 will be deformed, that is, the chord length of the circular groove thereof will be longer. Therefore, in order to accommodate the chord changes of the positive and negative electrical contacts 54, 55, a chord length of the positive electrical contact 54 is less than a maximum distance between the first and second positive holes 5211, 5212, and a chord length of the negative electrical contact 54 is less than a maximum distance between the first and second negative holes 5221, 5222 in the initial state of the positive and negative electrical contacts 54, 55. Moreover, when four free ends of the positive and negative electric contacts 54, 55 are inserted into the first and second positive holes 5211, 5212 and the first and second negative holes 5221, 5222 respectively, the positive and negative power contacts 54, 55 rotate secondly whose direction of rotation is opposite to the direction of the first rotation so as to make the first positive free end 5211 and the first negative free end 5221, which move toward the top cover 52, respectively abut against the bar bus 30 so as to electrically connect therebetween. The second positive free end 5212 and the second negative free end 5222 will abut against the supply strip placement board 21. Moreover, as the positive and negative electric contacts 54, 55 will occur deformation when they are pressed between the supply strip placement board 21 and the abutting board 22. As a result, one of the respective two free ends of the positive and negative electric contacts 54, 55 will tightly abut against the bar bus 20 so as to avoid from virtual connection. At the same time, the middle sections of the positive and negative electric contacts 54, 55 are electrically connected to the electrical contacts 533 so as to transmit power to the power plug assembly.

As described above, when the support arm 40 of the shelf system 100 is inserted into the punched hole 11 of the vertical shelf rail 10, the assembly of the support arm 40 can be completed without being affected by the electrical supply 50. As a result, the influence of the tolerance fitting suffered, when assembling the vertical shelf rail 10, back plate, and the support arm 40, is reduced to the minimum.

Figure 6:
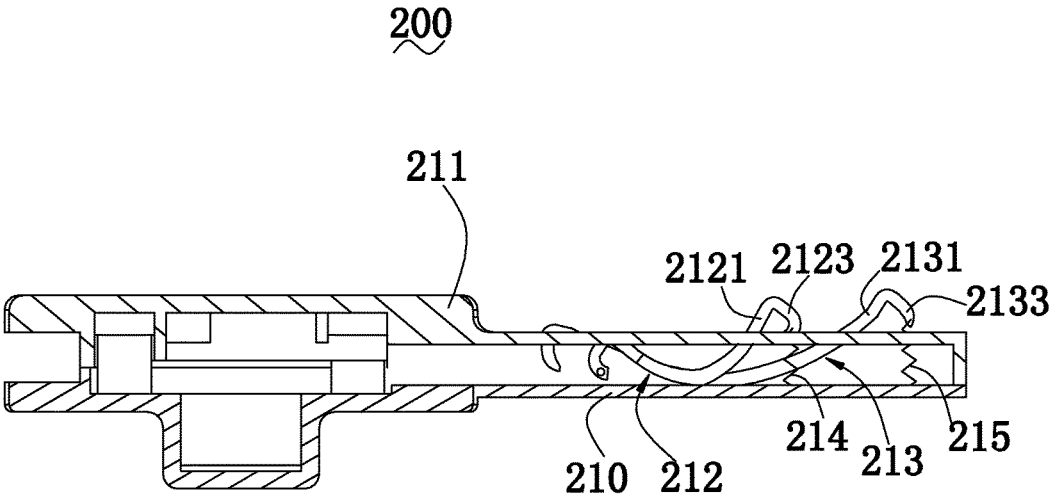
FIG. 6 is a schematic view of an electrical supply and a shelf system according to a second embodiment.

Referring to FIG. 6, an electrical supply 200 of the shelf system according to a second embodiment is shown. The difference between the second embodiment and the first embodiment is only that the structure of the electrical supply. Therefore, the electrical supply 200 of the second embodiment is shown in FIG. 6 and only the structure and work principle thereof are explained and the other parts will not be described in detail, such as vertical shelf rail, support arm, and so on. The electrical supply 200 includes a bottom cover 210, a top cover 211 mounted on the bottom cover 210, and a positive and negative electric contacts 212, 213 sandwiched between the bottom cover 210 and the top cover 211. In the present embodiment, the bottom cover 210, the top cover 211, and the positive and negative contacts 212, 212 have basically same structure with the bottom cover 51, the top cover 52, and the positive and negative electric contacts 54, 55 of the first embodiment and will not be described in detail. And in order to make the marks on the chart simple, all of the details are not labeled. Comparing the electrical supply 200 with the electrical supply 50 of the first embodiment, the electrical supply 200 has no the sandwich plate 52 of the first embodiment and includes two springs 214, 215. The two springs 214, 215 are respectively arranged between a first positive free end 2121 of the positive electric contact 212 and a first negative free end 2131 of the negative electric contact 213 and the bottom cover 210. In the present embodiment, one end of the respective springs 214, 215 is fixed in the curling portion 2123, 2133, and the other is fixed on the bottom cover 210.

When the electrical supply 200 has not be inserted into the punched hole of the vertical shelf rail, the springs 214, 215 are in an initial state, and the first positive free end 2121 and the first negative free end 2131 will extrude the hole of the top cover 211 and another will retract back the hole of the top cover 211. When the electrical supply 200 is inserted into the punched hole of the vertical shelf rail, the first positive free end 2121 and the first negative free end 2131, which are connected to the springs 214, 215, are first inserted into the punched hole. When the second positive free end 2122 and the second negative free end 2132 are also inserted into the punched hole, the spring 214, 215 will be compressed and the first positive free end 2121 and the first negative free end 2131 will abut against on the bus bar so as to electrically connect therebetween. Moreover, the second positive free end 2122 and the second negative free end 2133 will abut against on the supply strip placement board.

Because of the springs 214, 215, the sandwich plate 53 of the first embodiment can be cancelled. In result, the height of the electrical supply 200 can be further reduced. As for the electrical connection with the power plug assembly, the springs 214, 215 can be electrically connected to the power plug assembly in via of wires to establish electrical connection therebetween. Moreover, the wires can be directly arranged on the bottom cover 210.

Figure 7:
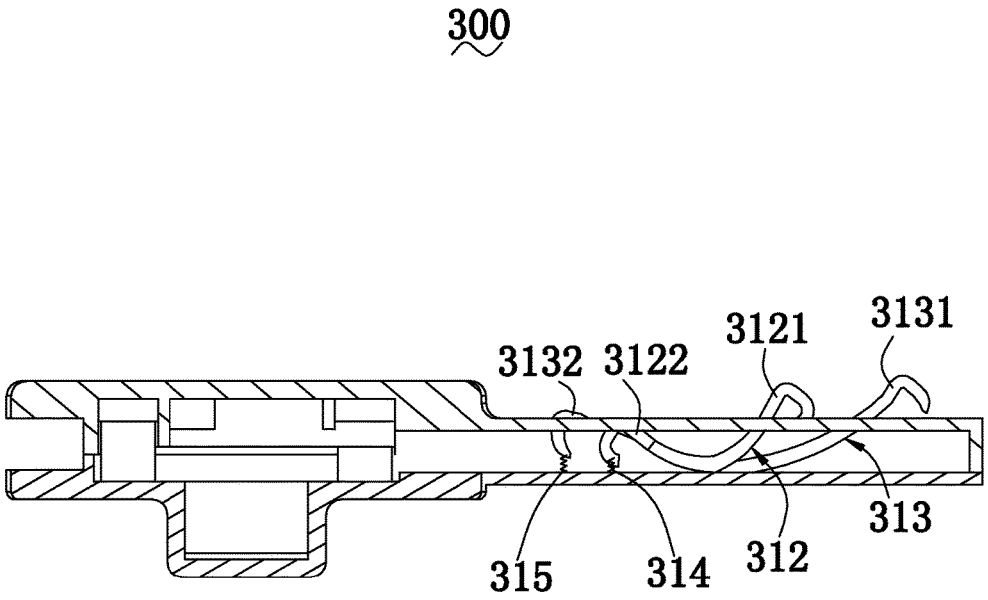
FIG. 7 is a schematic view of an electrical supply and a shelf system according to a third embodiment.

Referring to FIG. 7, an electrical supply 300 of the shelf system of a third embodiment is shown. The difference between the electrical supply 300 of the third embodiment and the electrical supply 200 only is the setting position of the spring. Comparing with the second embodiment, the springs 314, 315 may be assembled in another free ends of the positive and negative electric contacts 312, 313, that is, the second positive free end 3122 and the second negative free end 3132. The springs 314, 315 may be extension springs or compression springs. When the electric supply 300 has not been inserted into the punched hole of the vertical shelf rail, the springs 314, 315 is in the initial state. And the first positive free end 3121 and the first negative free end 3131 will respectively extend out of the first positive hole and the first negative hole. However, the other free end, that is, the second positive free end 3122 and the second negative free end 3132 will respectively retract back of the second positive hole and the second negative hole.

When the electrical supply 300 is inserted into the punched hole of the vertical shelf rail, the first positive free end 3121 and the first negative free end 3131 will be firstly inserted into the punched hole so as to make the springs 314, 315 enter into extension state. While the second positive free end 3122 and the second negative free end 3132 are also inserted into the punched hole of the vertical shelf rail, the springs 314, 315 will be kept on tension and the first positive free end 3121 and the first negative free end 3131 will abut against the bus bat to establish the electrical connection. Moreover, the second positive free end 3122 and the second free end 3123 abut against the supply strip placement board. Because of the springs 314, 315, the first positive free end 3121 and the first negative free end 3131 always abut against the bus bar under the pressure of the springs 314, 315 so as to avoid from virtual connection.

Figure 8:
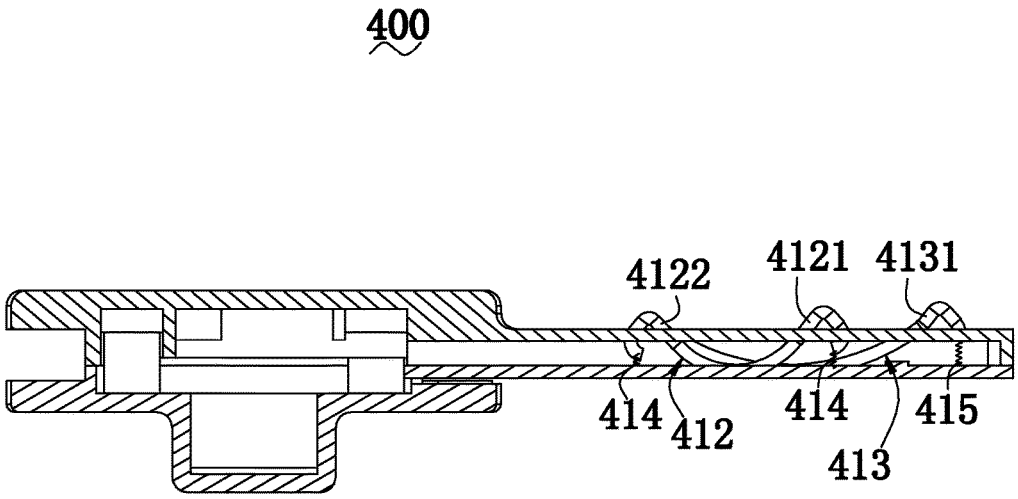
FIG. 8 is a schematic view of an electrical supply and a shelf system according to a fourth embodiment.

Referring to FIG. 8, an electrical supply 400 of the shelf system according to a fourth embodiment is shown. The difference between the fourth embodiment and the second, third embodiment is only the setting position and quantity of the springs. In the fourth embodiment, two free ends of a positive electrical contact 412 and a negative electrical contact 413 of the electrical supply 400 have two springs 414, 415 disposed thereon. Specifically, the positive electrical contact 412 includes a first positive free end 4121 and a second free end 4122 and the negative electrical contact 413 includes a first negative free end 4131 and a second negative free end 4132. The first and second positive free ends 4121, 4122 have the springs 414 respectively disposed thereon. The first and second negative free ends 4131, 4132 have the springs 415 respectively disposed thereon. Moreover, the first and second positive free ends 4121, 4122 and the first and second positive free ends 4131, 4132 must reach out of the positive and negative holes 421, 422 of the top cover in the initial state.

While the disclosure has been described by way of example and in terms of exemplary embodiment, it is to be understood that the disclosure is not limited thereto. To the contrary, it is intended to cover various modifications and similar arrangements. Therefore, the scope of the appended claims should be accorded the broadest interpretation so as to encompass all such modifications and similar arrangements.

What is claimed is:

1. An electrical supply, comprising:

a bottom cover;

a top cover mounted on the bottom cover, the top cover comprising a row of positive collector holes and a row of negative collector holes spaced apart from the positive collector holes, the positive holes comprising a first positive hole and a second positive hole spaced apart from the first negative hole, the negative collector holes comprising a first negative hole and a second negative hole spaced apart from the first negative hole, the positive and negative collector hole being slots; and a positive electric contact and a negative electric contact, the positive electric contact comprising a first positive free end and a second positive free end, the first and second positive free ends being inserted through the first and second positive holes, the negative electric contact comprising a first negative free end and a second negative free end, the first and second negative free ends being inserted through the first and second negative holes, a chord length of the positive electric contact being less than a maximum distance between the first and second positive holes of the positive collector hole, a chord length of the negative electric contact being less than a maximum distance between the first and second negative holes of the negative collector hole, when the first positive free end of the positive electric contact moves towards the top cover, the second positive free end of the positive electric contact moves away from the top cover, when the first negative free end of the negative electric contact moves towards the top cover, the second negative free end of the positive electric contact moves away from the top cover.

2. The electrical supply as claimed of claim 1, wherein middle sections of the positive and negative power contacts are abutted against the bottom cover.

3. The electrical supply as claimed of claim 1, wherein the positive and negative power contacts are arc-shaped groove, and two slots are opened on the bottom cover and are configured for receiving the positive and negative collector respectively, and portions where the positive and negative power contacts are in contact with the bottom cover are received in the slots.

4. The electrical supply as claimed of claim 3, wherein the slots are through holes, and the portions where the positive and negative power contacts are in contact with the slots are arc-shaped surface.

5. The electrical supply as claimed of claim 3, wherein the electrical supply further includes a sandwich plate arranged between the bottom cover and the top cover, and the sandwich plate includes two through holes which are configured for respectively crossing through the positive and negative power contacts, an electrical contact is disposed on each of the two through holes so as to electrically connect to the positive and negative collector respectively.

6. The electrical supply as claimed of claim 3, wherein each of the free ends of the positive and negative collector include a curling portions and the curling portions are curved outward of the positive and negative power contacts, the bottom cover includes four through holes for receiving the curling portions respectively while the curling portions are pressed.

7. The electrical supply as claimed of claim 1, wherein the two springs are respectively arranged between a first positive free end of the positive electric contact and a first negative free end of the negative electric contact and the bottom cover, the first positive free end and the first negative free end respectively extend out of the first positive hole and the first negative hole, the positive and negative collector are sandwiched between the bottom cover and the top cover.

8. The electrical supply as claimed of claim 1, wherein the two springs are respectively arranged between a second positive free end of the positive electric contact and a second negative free end of the negative electric contact and the bottom cover, the first positive free end and the first negative free end respectively extend out of the first positive hole and the first negative hole, the positive and negative collector are sandwiched between the bottom cover and the top cover.

9. The electrical supply as claimed of claim 1, wherein the two springs are respectively arranged between a first and second positive free end of the positive electric contact and a first and second negative free end of the negative electric contact and the bottom cover, the first positive free end and the first negative free end respectively extend out of the first positive hole and the first negative hole, the positive and negative collector are sandwiched between the bottom cover and the top cover.

10. A shelf system, comprising:

a plurality of vertical shelf rails, supporters disposed in the vertical shelf rails, two bus bars arranged in the supporters, at least one support arm arranged in each of the vertical shelf rails, at least one electrical supply disposed on the support arm, the vertical shelf rail being hollow rail, each of the vertical shelf rails including at least one row of punched holes wherein each of rows has a plurality of punched holes, the supporters being made of insulating material, and the two bus bars being adjacent to each other along a length extension of the vertical shelf rails and insulatively disposed in the inner cavity of the vertical shelf rails, the support arm including a nose-shaped insertion hook configured for engaging with the punched holes and the electrical supply being disposed on the nose-shaped insertion hook, the electrical supply including a bottom cover and a top cover mounted on the bottom cover, a positive current collector and a negative current collector sandwiched between the top cover and the bottom cover, the top cover including two rows of positive collector hole and negative collector hole which are spaced apart from each other, the positive collector hole including a first positive hole and a second positive hole spaced apart from the first positive hole, the negative collector hole including a first negative hole and a second negative hole spaced apart from the first negative hole, the positive and negative power contacts being in contact with the slots, the positive collector including a first positive free end and a second positive free end, the negative collector including a first negative free end and a second negative free end, the first positive free end and the second positive free end of the positive collector being respectively inserted into the first and second positive holes, the first negative free end and the second negative free end of the negative collector are respectively inserted into the first and second positive holes, a chord length of the positive electrical contact being less than a maximum distance between the first and second positive holes and a chord length of the negative electrical contact being less than a maximum distance between the first and second negative holes in the initial state of the positive and negative electrical contacts, and when four free ends of the positive and negative electric contacts are inserted into the first and second positive holes and the first and second negative holes respectively, the positive and negative power contacts rotate secondly whose direction of rotation is opposite to the direction of the first rotation so as to make the first positive free end and the first negative free end, which move toward the top cover, respectively abut against the bar bus so as to electrically connect therebetween, the second positive free end and the second negative free end will abut against the supply strip placement board.

11. A shelf system as claimed of claim 10, wherein the supporters includes a supply strip placement board and the abutting board arranged two sides of the supply strip placement board and spaced apart from the supply strip placement board, and the electrical supply is inserted between the supply strip placement board and one of the two abutting boards.

12. A shelf system as claimed of claim 11, wherein a maximum distance between the top cover and the bottom cover corresponds to the minimum distance between the supply strip placement board and the abutting board.

* * * * *